United States Patent [19]

Moser et al.

[11] 3,976,371

[45] Aug. 24, 1976

[54] MOUNTING ARRANGEMENT FOR COMPONENT ELEMENTS OF COPYING MACHINE

[75] Inventors: Kurt Moser, Gerlingen; Reinhold Weigele, Korntal, both of Germany

[73] Assignee: Develop KG/Dr. Eisbein and Co., Germany

[22] Filed: Aug. 16, 1974

[21] Appl. No.: 498,110

[30] Foreign Application Priority Data

Aug. 16, 1973 Germany ..... 2341531

[52] U.S. Cl. ..... 355/3 DD; 118/637

[51] Int. Cl.[2] ..... G03G 15/00

[58] Field of Search ..... 355/3 DD, 3 R, 14; 118/637, DIG. 24; 117/17.5; 222/DIG. 1; 96/15 D

[56] References Cited

UNITED STATES PATENTS

| | | | |
|---|---|---|---|
| 3,181,420 | 5/1965 | Rautbord et al. | 355/14 |
| 3,324,791 | 6/1967 | Cassano et al. | 355/14 X |
| 3,512,885 | 5/1970 | Osborne et al. | 355/14 |
| 3,689,146 | 9/1972 | Ito et al. | 355/8 |

*Primary Examiner*—R. L. Moses

*Attorney, Agent, or Firm*—Craig & Antonelli

[57] ABSTRACT

A detachably engaged unit is provided for association with a copying machine wherein the unit contains a housing which is detachably connected through a power coupling to the copying machine. The unit includes a support arrangement for supporting a sheet of paper having an image thereon in charge relief, a conveying arrangement for transferring the sheet of paper containing the image thereon to a station where chargeable powder is transferred to the charged surface, and a pressing arrangement spaced rearwardly therefrom for fixing the image on the paper under pressure. The unit makes it possible to readily detach the support arrangement, the powder applying arrangement and the pressing arrangement from the copying machine for repair, replacement or service.

23 Claims, 4 Drawing Figures

Figure 1:
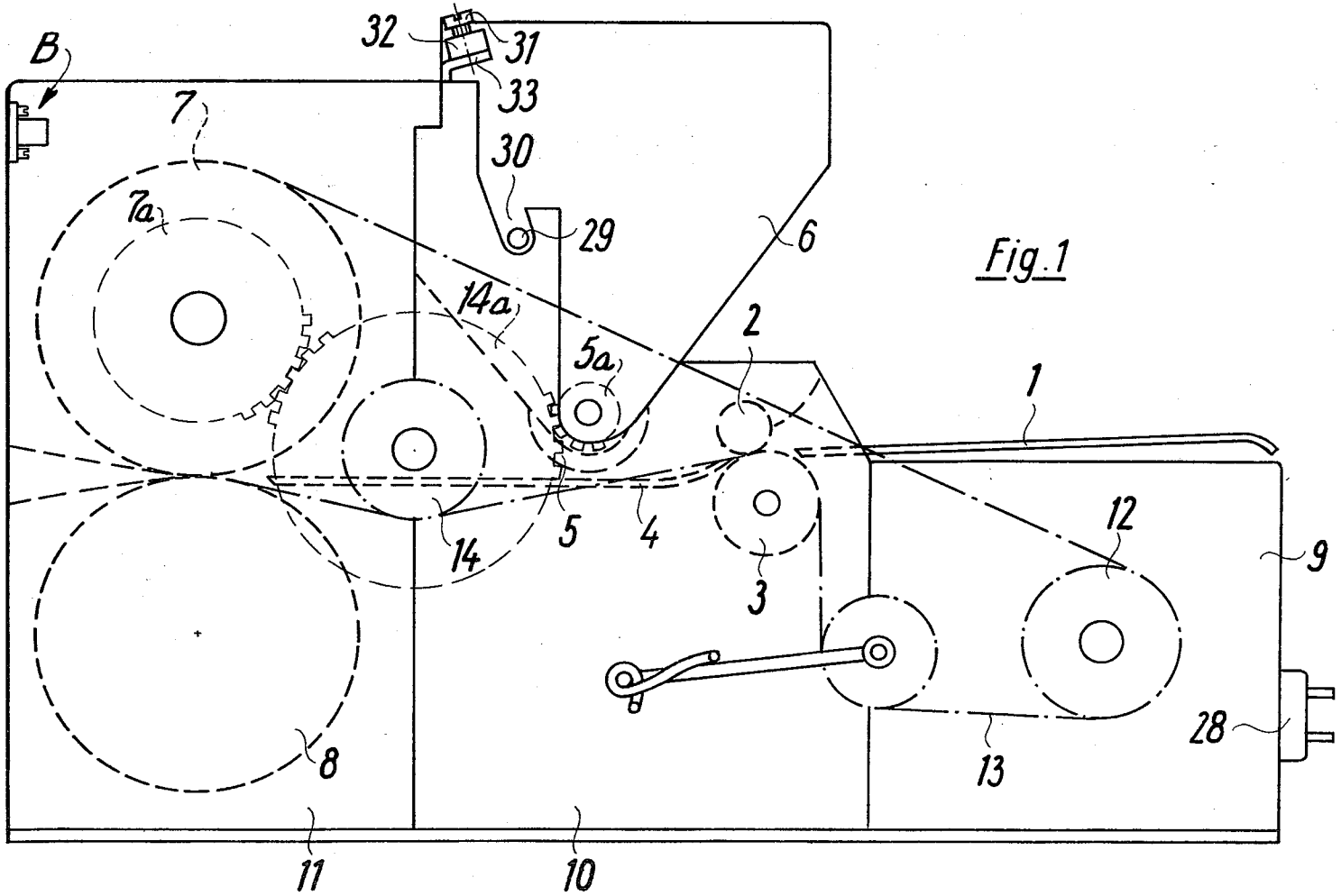

1
2
3
4
5
5a
6
7
7a
8
9
10
11
12
13
14
14a
28
29
30
31
32
33
B

MOUNTING ARRANGEMENT FOR COMPONENT ELEMENTS OF COPYING MACHINE

The present invention relates to a copying machine arrangement, more particularly, to an improved copying machine arrangement of the type which includes a means for transferring the image to be copied to a coated sheet of paper or the like as a charge relief thereon, and means for applying and fixing a magnetizable powder on the surface of the sheet to set the image thereon. The powder applying means having a magnetized roller covered with the magnetic powder with a pair of pressure rollers being disposed downstream of the powder applying means for fixing the image on the sheet of paper under pressure.

In a copying machine of the type to which the present invention is directed, a common occurrence is for the coated paper to jam in the machine. When this occurs it is necessary that the machine be stopped and then opened so that the sheet or sheets causing the jam can be removed. In many machines of this type the paper is not readily accessible and the sheets causing the jamming can only be removed from the paper guide by means of tweezers or the like.

The aid underlying the present invention essentially resides in improving the copying machine arrangement of the general type hereinbefore described by enabling most of the component parts making up the arrangement, and particularly, the means for applying and fixing the magnetizable powder to be readily accessible.

According to one feature of the present invention, the means for applying and fixing the magnetizable powder to the paper is in the form of a unit which is slidable into and out of the copying machine in the manner of a drawer and is placed in a common housing with the image transfer unit. Thus, in accordance with the present invention it is possible to completely uncover the means for applying and fixing the magnetizable powder by moving the same out of the housing. In this way a refilling with powder or cleaning and servicing of this mechanism can easily be accomplished. According to a further feature of the present invention the drawer-like unit is so arranged as to be displaceable in the conveying direction of the coated paper. This arrangement insures the removability of the drawer-like unit without any impairment that might result from a paper jam. It will be found, to the contrary, that this type of arrangement can oftentimes free a paper jam by pulling out the drawer-like unit.

A further advantage of the present invention resides with respect to the servicing and repair operations of the copying machine which is provided with the drawer-like unit of the present invention. Specifically, slide guides are provided and detachably connected to the drawer-like unit whereby the drawer-like unit can be withdrawn to an extended state in a simple manner by a maintenance man and, if necessary, can be withdrawn and replaced with a spare unit. Under such circumstances it will be desirable to provide the drawer-like unit with a separate drive means. The provision of a separate drive means for the individual units gives the further advantage that the rate at which the means for applying and fixing the powder will now be independent of the rate of movement of the means transferring the picture to be copied. In this way, a negative effect upon the image transfer will be safely avoided.

According to a further feature of the present invention, a plug connection is provided which closes the drawer-like unit and is employed for the purpose of connecting the unit to the power supply and control elements of the copying machine. This results, on the one hand, in the advantage that the drawer-like unit will be electrically disconnected when the unit has been pulled out, while, on the other hand, improper electrical connections after servicing or the like can be completely avoided.

Figure 1A:
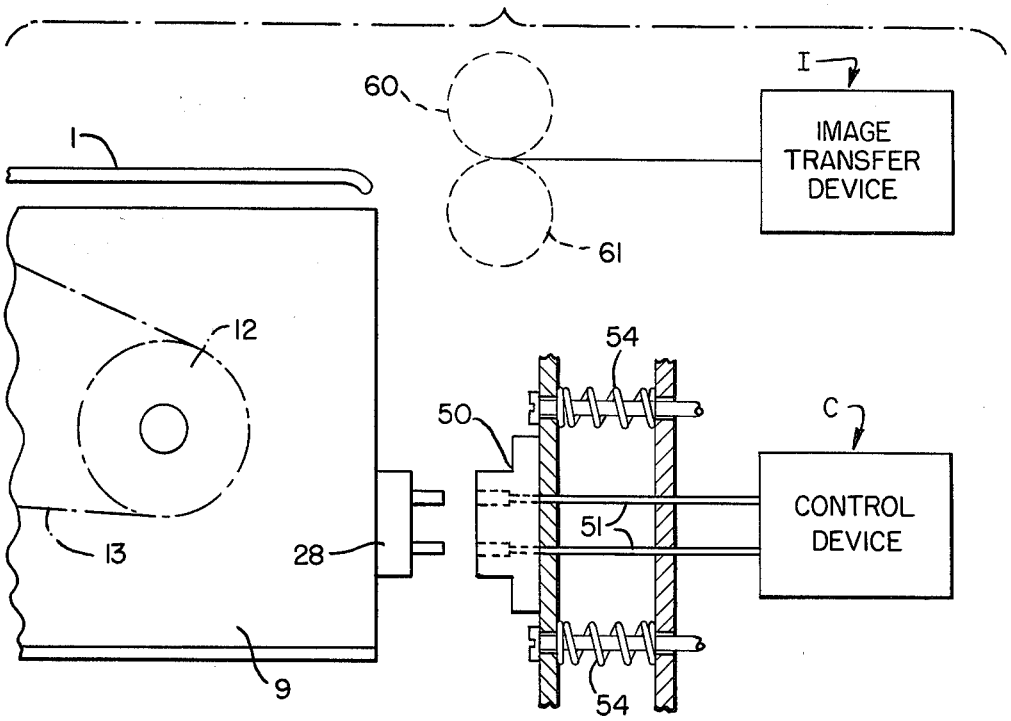
Figure 2:
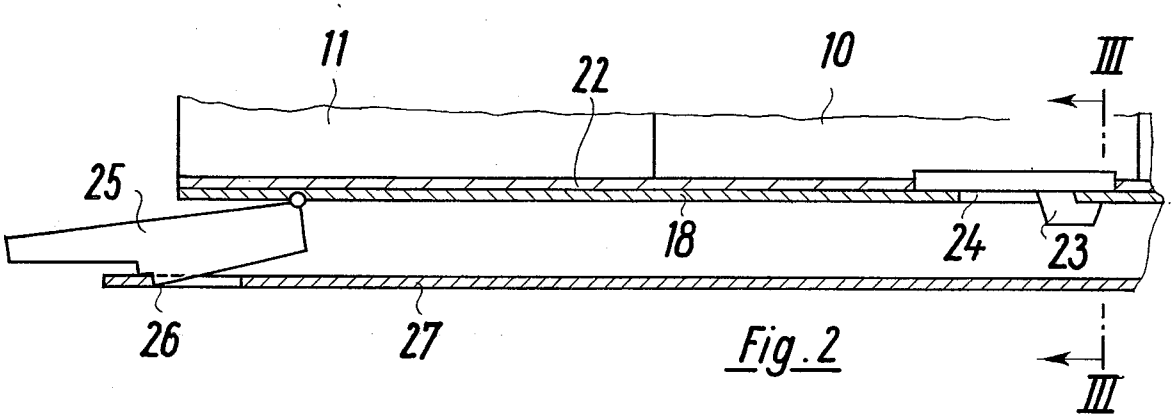
Figure 3:
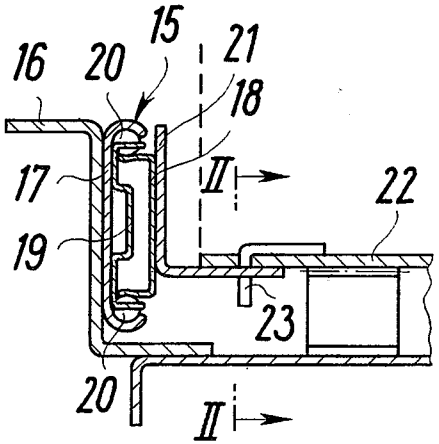

These and other objects, features, and advantages of the present invention will be readily apparent from the ensuing description when taken in conjunction with the accompanying drawings which show for the purposes of illustration only, one embodiment of the present invention, and wherein:

FIG. 1 is a side view of a device constructed according to the present invention for the application and fixation of a magnetizable powder without an associated sliding guide;

FIG. 1*a* is an exploded partial cross-sectional view of the plug connection, control device, and image transfer device in accordance with the present invention;

FIG. 2 is a partial cross-sectional view taken along lines II—II of FIG. 3; and FIG. 3 is a cross-section through the sliding guide of one side of the device of the present invention.

Referring now to the drawings wherein like reference numerals are used throughout the various views to designate like parts, a portion of the copying machine shown in part in FIGS. 1 1*a* includes a baffle plate 1 which is connected to a device generally designated by the reference character I for transfer of the picture or image with a pair of feed rollers 60, 61 shown in broken line functioning as a conveying device for moving a paper sheet from the image transfer device I to the baffle plate 1. The baffle plate 1 functions to convey a paper sheet or the like which is provided with a charge relief to an auxiliary conveying means consisting of a pair of rollers 2 and 3. This auxiliary conveying means 2, 3 advances the paper sheets toward a guiding surface element 4 so that the paper will be passed along beneath a magnetized roller 5. The magnetized roller 5 is mounted for rotation in the bottom of a powder container or hopper 6 with a portion of the roller projecting through a slot formed therein. The causing 6 contains a magnetizable powder which may be, for example, carbon dust mixed with iron dust. The outside layer of the roller 5 will be convered by a fur-like appearing powder layer which, on the basis of different charge potentials of the powder, will be, in part, transferred from the roller to the charged paper. The guiding surface element 4 over which the paper moves guides the paper sheet after receiving the magnetizable powder thereon to a pair of pressure rollers 7, 8 which will cause a fixation of the powder thereon by application of high pressure. The constructional arrangement of the guiding surface element 4, auxiliary conveying device 2, 3, powder applying arrangement 5, 6, and pressure roller means 7, 8, may be, for example, of the type disclosed in commonly assigned U.S. patent application Ser. Nos. 498,235 and 489,236 corresponding to German patent applications P 23,41,529.4, P 23,41,530.7, respectively and entitled Apparatus for Applying and Fixing a Magnetizable Powder on a Charged Sheet, and Pressing Installation for a Copying Arrangement, respectively, filed simultaneously with this application, the disclosures of which are incorporated herein by reference to the extent necessary.

As shown in FIG. 1, the illustrated portion of the copying machine is divided into three sections, 9, 10, and 11, the first section 9 containing a drive motor of conventional construction with only the motor pinion 12, shown in phantom line, being visible. The middle section 10 contains the auxiliary conveying means 2, 3, the magnetized roller 5, and the guiding surface element 4. The last section 11 contains the pair of pressure rollers 7, 8. It is also possible, if desired, to provide in the section a removably mounted air blower unit of the like generally designated by the reference character B fashioned as a transverse-flow blower. Such a blower will function to cool the lamp of the picture transfer unit.

The motor pinion 12, shown in section, functions to drive, by means of a drive chain or the like 13, the roller 3 of the auxiliary conveying means to advance the paper sheets to the guiding surface element 4. A chain wheel drive mechanism or sprocket 14 is positioned between sections 10 and 11 and serves to drive, by way of a gear train 5*a*, 7*a*, 14*a*, the magnetized roller 5 and the pressure roller 7 of the pair of pressure rollers 7, 8. This construction insures a synchronized and correlated movement of all the moving parts with one another. Therefore, it is possible to choose a rate of movement of the powder transfer means in that area which is smaller than the rate of movement in the area of the means which transfers the picture or image so that an undesirable effect upon the transfer device is not possible. In the event of a paper jam between the sections 10 and 11, it can be seen that the paper will readily be absorbed on the baffle plate 1.

The sections 9, 10 and 11 are fashioned to form an independent structural unit mounted, by means of a sliding guide generally designated by the reference numeral 15, shown most clearly in FIG. 3, to a base frame 16 of a common housing so that the entire unit consisting of sections 9, 10 and 11 can be slid out of the copying machine in the manner of a drawer in the feeding direction of the paper.

The sliding guide 15, which is provided on both sides of the drawer-like unit in mirror-image symmetry, consists of two profiled rails 17, 18 disposed one within the other between which balls 20 are provided and guided by cage 19. The profiled rail 17 is fixedly connected to the base frame 16 of the common housing, and the profiled rail 18 is displaceable along the rail 17. The displaceable rail 18 is joined with an angle or corner portion 21 attached to a bottom or base plate 22 of the unit composed of sections 9, 10, 11. The connection between the bottom plate 22 and the angle portion 21 is readily releasable, so that the entire structural unit composed of sections 9, 10 and 11 can be separated from the sliding guide 15 and can be removed entirely from the copying machine housing.

The base plate 22 is provided with a hook-shaped projection 23 which projects downwardly and is adapted to engage a slot 24 provided in the corner portion 21 as can be clearly seen in FIG. 2. In the final position shown in FIG. 2, bores (not shown) in the area of the rear end of the corner portion 21 coincide with tapped bores of the base plate 22 into which fastening means such as screws or the like can be positioned.

The locking of the structural unit in the housing is accomplished by means of a locking lever 25 which is hingedly attached to the rail 18 and is spring-loaded for movement in a counterclockwise direction. The lever, in an installed position, will protrude somewhat outwardly beyond the edge of the housing. The lever 25 is provided at its lower edge with a projection or stud 26 which, when the unit is in a closed position, will engage a recess formed in the base plate 27 which closes off the base frame 16 of the housing on the underside thereof and forms the bottom of the machine housing. To insure that the lever 25 will remain in a locked position and thereby retain the unit composed of sections 9, 10 and 11, spring tension means (not shown) acting in the pull-out direction of the drawer-like unit are provided. The spring tension means can advantageously be actuated by a plug connection 28, 50 which establishes by way of cables 51 on the like, when the drawer-like unit is in the inserted position, the connection to a power supply and the control device generally designated by the reference character C of the copying machine.

As shown in FIG. 1*a* the plug 28 to which a socket 50 of conventional design is connected mounted to the housing of section 9. Preferably, the plug connection 28, 50 is resiliently or movably mounted on the housing in the direction of movement of the drawer-like unit. This latter constructional arrangement can be achieved in a simple manner by means of guide screws 54 or the like in which the screws 54 are surrounded by spiral springs 53. By means of such screws 54, a required pretension can be set and a safe contact can also be assured by such spring tension.

As shown in FIG. 1, the magnetized roller 5 mounted within the lower end of the powder container 6 forms a unit which is detachably fastened to the section 10 so that the formed unit can be removed upwardly from the section 10. Moreover, provision is made that the magnetized roller 5 with the powder container 6 can be adjusted vertically with respect to the guiding surface element 4 so that the distance between these two elements can be adjusted. For this purpose, bolts 29 are provided on both sides of the powder container 6 and are positioned in slotted guides 30 which extend in such the direction that a toothed gear 5*a* engaging the gearing 14*a* by which the magnetized roller 5 is driven through the sprocket wheel 14 will be displaced tangentially towards the corresponding gearing 14*a*. The desired adjustment may be accomplished by means of a set screw or the like 31 which is screwed into a tapped bore of stud 32 of the powder container 6 and rests on an annular flange 33. While we have shown and described only one embodiment in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are encompassed by the scope of the appended claims.

What is claimed is:

1. A copying arrangement including means for transferring an image as a charge relief onto a coated paper sheet or the like, the arrangement comprising: a housing means for housing the image transfer means, means for applying and fixing a magnetizable powder onto the paper sheet, means for conveying the paper sheet to said means for fixing and applying the magnetizable powder, a casing means for accommodating said means for applying and fixing the magnetizable powder and said means for conveying the paper sheet, means for mounting said casing means in said housing so as to be displaceable in the conveying direction of the paper in the manner of a drawer, said means for applying and fixing a magnetizable powder onto the paper sheet includes a magnetized roller means, means for mounting said magnetized roller in proximity to the sheet, and pressure roller means disposed downstream of said magnetized roller means for fixing the magnetizable powder to the paper sheet.

2. An arrangement according to claim 1, wherein said means for mounting said casing means includes sliding guide means disposed in said housing means.

3. An arrangement according to claim 2, wherein means are provided for detachably connecting said casing means to said sliding guide means.

4. An arrangement according to claim 3, wherein independent drive means are provided in said casing means, and means are provided for connecting said drive means with said means for applying and fixing the magnetizable powder onto the paper sheet and said means for conveying the paper sheet.

5. An arrangement according to claim 4, wherein the copying arrangement includes control elements for controlling the same, and wherein said housing means and said means are provided with a plug means for connecting said drive means with said control elements when said casing means is displaced into said housing means.

6. An arrangement according to claim 5, wherein said plug means includes a plug disposed on said casing means and a socket disposed on said housing means.

7. An arrangement according to claim 1, wherein said pressure roller means is disposed in said casing means downstream of said magnetized roller means.

8. An arrangement according to claim 1, wherein said means for mounting said casing means includes sliding guide means disposed in said housing means.

9. An arrangement according to claim 8, wherein means are provided for detachably connecting said casing means to said sliding guide means.

10. An arrangement according to claim 9, wherein said housing means includes a base frame means disposed on at least two opposed sides of said casing means, and wherein said slide guide means includes a first profiled rail means fixedly secured to said base frame means on respective sides of said casing means, a second profiled rail means connected to said casing means and displaceable within said first profiled rail means.

11. An arrangement according to claim 7, wherein means are provided for locking said casing means in said housing means.

12. An arrangement according to claim 11, wherein said means for mounting said casing means includes sliding guide means disposed in said housing means.

13. An arrangement according to claim 12, wherein means are provided for detachably connecting said casing means to said sliding guide means.

14. A copying arrangement including means for transferring an image as a charge relief onto a coated paper sheet or the like, the arrangement comprising: a housing means for housing the image transfer means, means for applying and fixing a magnetizable powder onto the paper sheet, means for conveying the paper sheet to said means for fixing and applying the magnetizable powder, a casing means for accommodating said means for applying and fixing the magnetizable powder and said means for conveying the paper sheet, means for mounting said casing means in said housing means so as to be displaceable in the conveying direction of the paper in the manner of a drawer, said means for applying and fixing a magnetizable powder onto the paper sheet includes a magnetized roller means, means for mounting said magnetized roller in proximity to the paper sheet, pressure roller means disposed downstream of said magnetized roller means for fixing the magnetizable powder to the paper sheet, said means for mounting said casing means includes sliding guide means disposed in said housing means, means for detachably connecting said casing means to said sliding guiding means, independent drive means provided in said casing, means for connecting said drive means with said means for applying and fixing the magnetizable powder onto the paper sheet and said means for conveying the paper sheet, control elements for controlling the copying arrangement, plug means provided at said housing means and said casing means for connecting said drive means with said control elements when said casing means is displaced into said housing means, said plug means includes a plug disposed on said casing means and a socket disposed on said housing means, and means for resiliently mounting said socket on said housing means.

15. An arrangement according to claim 14, wherein said means for resiliently mounting said socket includes at least one guide member having at least one spring means disposed thereon.

16. An arrangement according to claim 14, wherein said means for applying and fixing the magnetizable powder further includes a powder container means for receiving the magnetizable powder, said magnetized roller means being rotatably mounted at the lower end of said container means.

17. An arrangement according to claim 16, wherein means are provided for mounting said container means so as to be removable in a direction substantially perpendicular to the direction of displacement of said casing means.

18. An arrangement according to claim 17, wherein said drive means includes a drive motor, and wherein said means for connecting said drive means with said means for applying and fixing the magnetizable powder includes a gear train means for driving said magnetized roller means, and a chain means for operatively connecting said gear train means with said drive motor and said pressure roller means.

19. An arrangement according to claim 18, wherein said casing means is divided into a plurality of sections, a first section of said casing means accommodating at least said drive motor, a second section of said casing means accommodating said magnetized roller means and said powder container means, and a third section accommodating said pressure roller means.

20. An arrangement according to claim 19, wherein blower means are disposed in said casing means, and means are provided for removably mounting said blower means in said casing means.

21. A copying arrangement including means for transferring an image as a charge relief onto a coated paper sheet or the like, the arrangement comprising: a housing means for housing the image transfer means, means for applying and fixing a magnetizable powder onto the paper sheet, means for conveying the paper sheet to said means for fixing and applying the magnetizable, powder, a casing means for accommodating said means for applying and fixing the magnetizable powder and said means for conveying the paper sheet, means for mounting said casing means in said housing means so as to be displaceable in the manner of a drawer, said means for mounting said casing means includes sliding guide means disposed in said housing means, means are provided for detachably connecting said casing means to said sliding guide means, said housing means includes a base frame means disposed on at least two opposed sides of said casing means, said slide guide means includes a first profiled rail means fixedly secured to said base frame means on respective sides of said casing means, a second profiled rail means connected to said casing means and displaceable within said first profiled rail means, said casing means further includes a bottom plate means, said means for detachably connecting said casing means with said sliding guide means includes a member connected to said second profiled rail means, a hook-shaped lug means disposed on said bottom plate means, and at least one aperture disposed in said member connected to said second profiled rail means for receiving said lug means.

22. An arrangement according to claim 21, wherein means are provided for locking said casing means in said housing means.

23. An arrangement according to claim 22, wherein said locking means includes a spring biased latch means, said latch means being pivotally mounted on said member connected to said second profiled rail means, said housing means including at least one aperture for receiving said latch means to latch said casing means in said housing means.

* * * * *